US006753041B2

(12) United States Patent
Pron et al.

(10) Patent No.: US 6,753,041 B2
(45) Date of Patent: Jun. 22, 2004

(54) METHOD FOR PREPARING CONDUCTIVE COMPOSITE MATERIALS BY DEPOSITION OF A CONDUCTIVE POLYMER IN AN INSULATING POROUS SUBSTRATE AND SOLUTION FOR USE IN SAID PREPARATION

(75) Inventors: Adam Pron, St. Egzève (FR); Jean-Pierre Travers, St Martin d'Hefes (FR); Jacek Niziol, Cracovie (PL)

(73) Assignees: Commissariat a l'Energie, Paris (FR); Centre National de la Recherche, Paris (FR)

( * ) Notice: Subject to any disclaimer, the term of this patent is extended or adjusted under 35 U.S.C. 154(b) by 0 days.

(21) Appl. No.: 10/312,890

(22) PCT Filed: Jul. 3, 2001

(86) PCT No.: PCT/FR01/02127

§ 371 (c)(1),
(2), (4) Date: Dec. 31, 2002

(87) PCT Pub. No.: WO02/03396

PCT Pub. Date: Jan. 10, 2002

(65) Prior Publication Data

US 2003/0138566 A1 Jul. 24, 2003

(30) Foreign Application Priority Data

Jul. 5, 2000 (FR) ..... 00 08737

(51) Int. Cl.[7] ..... B05D 5/12

(52) U.S. Cl. ..... 427/389.7; 427/391; 427/393.5; 427/393.6; 427/407.2; 427/411; 427/412.1

(58) Field of Search ..... 427/385.5, 389.7, 427/393.5, 393.6, 391, 407.2, 411, 412.1

(56) References Cited

U.S. PATENT DOCUMENTS 5,248,554 A * 9/1993 Hsu ..... 428/395
5,294,504 A * 3/1994 Otagawa et al. ..... 429/213
5,948,234 A * 9/1999 Kinard et al. ..... 205/200
6,042,740 A * 3/2000 Uehara et al. ..... 252/62.2
6,235,220 B1 5/2001 Pron et al.
6,265,532 B1 7/2001 Nicolau et al.

FOREIGN PATENT DOCUMENTS

JP 05-072791 * 3/1993
JP 06-120086 * 4/1994
WO WO 98/05040 A1 2/1998
WO WO 99/07766 A1 2/1999

OTHER PUBLICATIONS

Cao et al, Synthetic Metals, 69, pp 187–190, 1995.*

Luzny et al, Synthetic Metals, 119(1–3), pp 203–204, 2001.*

Wei et al, Chemistry of Materials, 7(5), pp 969–974, 1995.*

Cho, et al., "An Amperometric Urea Biosensor Based on a Polyanilline—Perfluorosulfonated Ionomer Composite Electrode", Analytical Chemistry, vol. 70, No. 18, pp. 3946–3951(Sep. 15, 1998).

(List continued on next page.)

*Primary Examiner*—Erma Cameron
(74) *Attorney, Agent, or Firm*—Burns, Doane, Swecker & Mathis, L.L.P.

(57) ABSTRACT

The invention relates to a method of preparing a conductive composite material, consisting of performing at least one cycle of deposition comprising the following steps:

(a) putting an insulating porous substrate (1) in contact with a solution of a conductive polymer such as polyaniline in a volatile organic solvent such as trifluoroacetic acid, and (b) eliminating the organic solvent by evaporation, for forming a deposit of conductive polymer (5) in the pores (3) of the porous substrate.

11 Claims, 2 Drawing Sheets

OTHER PUBLICATIONS

Dogan, et al., "Conducting Polymers of Aniline II. A Composite as a Gas Sensor", Synthetic Metals, 60, pp. 27–30 (1993).

Cao, et al., "Counter–ion Induced Processibility of Conducting Polyniline and of Conducting Polybends of Polyaniline in Bulk Polymers", Synthetic Metals, 48, pp. 91–96 (1992).

Beadle, et al., "Controlled polymerization of aniline at sub–zero temperatures", Synthetic Metals 95, pp. 29–45 (1998).

Sukeerthi, et al., "Molecular Sensors and Sensor Arrays Based on Polyaniline Microtubules", Anal. Chem. 71, pp. 2231–2236 (1999).

Zarbin, et al., "New Polyaniline/Porous Glass Composite", Synthetic Metals 84, pp. 107–108 (1997).

Wu, et al., "Polyaniline Wires in Oxidant–Containing Mesoporous Channel Hosts", Chem. Mater. pp. 1109–1112 (1994).

* cited by examiner

METHOD FOR PREPARING CONDUCTIVE COMPOSITE MATERIALS BY DEPOSITION OF A CONDUCTIVE POLYMER IN AN INSULATING POROUS SUBSTRATE AND SOLUTION FOR USE IN SAID PREPARATION

TECHNICAL FIELD

The present invention relates to the manufacture of electrically conductive composite materials comprising a conductive polymer such as polyaniline, in an insulating substrate.

It has particular application to the manufacture of porous membranes based on polymers and other insulating materials, rendered conductive by the conductive polymer.

Such materials can be used as electrodes, as gas sensors, as biological microsensors, or as filtration material for inflammable liquids.

DESCRIPTION OF PRIOR ART

Various methods are known which enable composite materials comprising a conductive polymer to be prepared.

Thus, the document Synthetic Metals, 60, 1993, pages 27–30 [1] describes the preparation of a composite polyaniline-poly (bisphenol-A carbonate) membrane used for the detection of ammonia. This composite membrane is obtained by electropolymerization of aniline on an electrode coated with polycarbonate. It contains about 50% by weight of polyaniline and has a conductivity of $10^{-2}$ S.cm$^{-1}$.

The document Anal. Chem., 1999, 71, pages 2231–2236 [21] describes sensors constituted by an isoporous membrane of polycarbonate coated with gold, in the pores of which a polyaniline is caused to grow by electropolymerization. An enzyme is then immobilized on the polyaniline by an electrochemical method.

The document Anal. Chem., 1998, 70, pages 3946–3951 [3] likewise describes biosensors comprising a composite electrode based on polyaniline and on Nafion® perfluorinated ionomer, which is obtained by deposition of the polyaniline by electropolymerization on a vitreous carbon electrode coated with Nafion®.

The document Synthetics Metals, 84, 1997, pages 107–108 [4] describes the preparation of a composite material based on porous glass and polyaniline obtained by the polymerization of aniline by chemical oxidation in situ in the pores of the porous glass.

The document Chem. Mater., 1994, 6, pages 1109–1112 [5] likewise describes a porous material in the pores of which polyaniline is formed by chemical polymerization in situ.

The methods described hereinabove for obtaining composites comprising a conductive polyaniline deposit polyaniline by also making use of electropolymerization or by chemical polymerization of aniline, and this has certain disadvantages.

The methods based on electropolymerization in fact make it necessary to first coat the insulating membrane with an electrically conductive material to permit the growth of polyaniline by electropolymerization. Such methods are furthermore not well suited to the preparation of membranes with large surfaces, since the electric field can be very inhomogeneous in an electrolytic cell of large dimensions, leading to the inhomogeneous deposition of conductive polymer. Furthermore, the electropolymerization reactions are very slow. Moreover, it is necessary to subject the membrane obtained by electropolymerization to a subsequent washing for eliminating the residues of salt and of electrolysis solvent, which could have a negative effect on the behavior of the membrane. Lastly, it should be noted that implementation of the process is lengthy.

In the methods using polymerization in situ by chemical means in the pores of the membrane, the process is difficult to control and the deposition of the conductive polymer can be inhomogeneous due to several factors which locally influence the chemical potential. Likewise, the product obtained has to be carefully washed to eliminate the secondary products of the reaction which would have a deleterious effect on the properties of the membrane, and the implementation of this method is likewise lengthy.

Another path for obtaining a film of composite material based on insulating polymer and conductive polymer, described in WO-A-98/05040 [6], consists of starting from a solution of conductive polymer and of insulating polymer in an appropriate solvent and forming a film by casting the solution and by evaporating the solvent. However, such a method is not suitable for obtaining conductive porous membranes.

SUMMARY OF THE INVENTION

The present invention has specifically as its object a method for preparing an electrically conductive composite material comprising a porous substrate made conductive by the deposition of a conductive polymer within the pores of the substrate.

According to the invention, the method for preparing an electrically conductive composite material comprising an insulating porous substrate and a conductive polymer disposed in the pores of the insulating substrate is characterized in that it consists in performing at least one cycle of deposition of the conductive polymer comprising the following steps:

(a) putting the porous substrate in contact with a solution of conductive polymer in a volatile organic solvent, chemically inert with respect to the porous substrate, and (b) eliminating the volatile organic solvent by evaporation for forming a deposit of conductive polymer in the pores of the porous substrate.

Generally, several successive cycles of deposition are performed, for example, three cycles of deposition, for obtaining a sufficient quantity of conductive polymer, not only in the pores but likewise on the external surface of the substrate.

The method of the invention is very advantageous, since it enables the deposition of conductive polymer to be effected in a single step, much easier and more rapid to implement than the steps necessary to perform a deposition by electropolymerization or by chemical polymerization in situ, and furthermore omitting the steps of washing.

According to the invention, the important characteristic is the choice of the volatile organic solvent used for forming the solution for deposition of conductive polymer within the pores of the porous substrate.

The solvent used should be chemically inert with respect to the porous substrate, that is, it should neither dissolve nor damage this substrate, and should ensure good dissolution of the conductive polymer.

In the case of polyaniline, it is known, for example, that this can be solubilized in solvents such as meta-cresol, as described in the document WO-A-99/07766 [7] as well as in the document [6] cited previously. But such solutions cannot be used for introducing polyaniline into a porous polymer substrate, because they likewise dissolve numerous insulating polymers.

In the document Synthetics Metals, 48, 1992, pages 91–97 [8], it is mentioned that polyanilines can be dissolved in certain solvents such as N-methyl pyrrolidone (NMP), certain amines, concentrated sulfuric acid or other strong acids, but in the case of NMP, it is necessary to then dope the polyaniline, which has become insulating. Furthermore, it is stated in this document that a polyaniline of high molecular weight cannot be doped in the conductive form, then dissolved in the conductive form in the usual, polar or weakly polar, organic solvents. According to this document, particular doping agents are used in order to place the polyaniline in solution in solvents such as meta-cresol, chloroform, and xylene.

According to the invention, other solvents are chosen, permitting:

(a) keeping the conductive polymer in the conductive form, (b) facilitating its penetration into the pores of the porous substrate, and (c) carrying out a uniform deposition of the conductive polymer.

With this object, solvents are chosen which are capable of dissolving a sufficient quantity of conductive polymer to form a solution containing, for example, 1–10 g/l of conductive polymer, and having an appropriate viscosity, for wetting the surface of the substrate. Moreover, an amphiphilic organic solvent is preferably chosen for obtaining a uniform deposit of conductive polymer on the hydrophilic and hydrophobic surfaces of the substrate.

By way of example of organic solvents which can be used, there can be mentioned acetic acid, the halogenated derivatives of acetic acid such as trifluoroacetic acid, and the fluorinated alcohols such as hexafluoroisopropanol.

According to the invention, the conductive polymer can be chosen among polyanilines, polypyrroles, polythiophenes and derivatives thereof.

According to the invention, a polyaniline is advantageously used, preferably of high molecular weight, and more preferably in the form of emeraldine base. Polyanilines of this type can be obtained by the methods described in the document [7] and the document Synthetics Metals, 95, 1998, pages 29–45 [9].

In the case in which the conductive polymer is a polyaniline, the solution used is advantageously a solution of polyaniline and of protonating agent in an amphiphilic volatile organic solvent.

The protonating agents used are chosen to facilitate placing the polyaniline in solution. In particular, there can be used the aliphatic and/or aromatic monoesters and diesters of phosphoric acid, sulfonic acids, and phosphonic acids.

In the case of esters of phosphoric acid, the aliphatic monoesters and diesters are preferred. Preferably, camphosulfonic acid is used as the protonating agent.

The porous substrates used in the invention can be of very diverse materials. For example, insulating polymers, filter papers, glasses, and ceramics may be concerned. The pores of the porous substrates used usually have a mean dimension of 0.2–100 $\mu$m.

For the implementation of the method according to the invention, the porous substrate is put in contact with the solution of conductive polymer, either by immersion of the substrate in the solution, or by spraying the solution onto the substrate, for example in the form of an aerosol. After this step, the deposit of polymer is formed within the pores and possibly on the external surface of the substrate, by the simple physical phenomenon of evaporation of the solvent with simultaneous solidification of the conductive phase of the conductive polymer in the form of a uniform layer. Thus, in contrast to the methods heretofore used for introducing a conductive polymer into the pores of an insulating substrate, no secondary product is formed; thus it is not necessary to proceed to the elimination of such products by washing. Moreover, the quantity and the morphology of the deposited conductive layer can easily be controlled by changing the polymer concentration in the deposition solution.

The invention furthermore relates to a solution of polyaniline which can be used for the deposition of conductive polyaniline onto a porous substrate, characterized in that it is constituted by a solution in trifluoroacetic acid of polyaniline in the form of emeraldine base and of a protonating agent.

The protonating agent is advantageously camphosulfonic acid. Preferably, the concentration of polyaniline in the solution is 1–10 g/l.

Other characteristics and advantages of the invention will become more apparent on reading the following description of embodiment examples, which are given, of course by way of example and not limitative, with reference to the accompanying drawings.

DETAILED DESCRIPTION OF EMBODIMENTS

An embodiment of the method of the invention using three successive cycles of deposition is shown in FIGS. 1–4.

Figure 1:
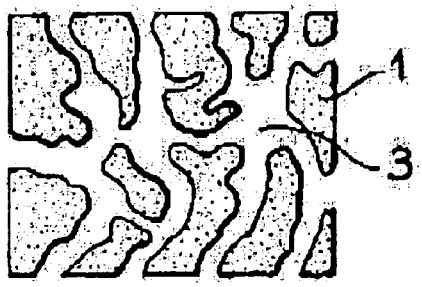
FIGS. 1–4 illustrate the preparation of a composite material according to the method of the invention by performing three successive cycles of deposition.

The porous substrate 1 provided with pores 3 is shown in FIG. 1 before the implementation of the method of the invention.

Figure 2:
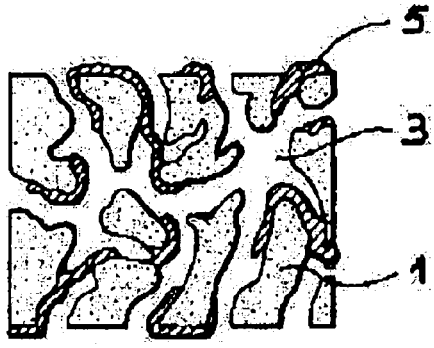

In the first deposition cycle, this substrate 1 is put in contact with a solution of conductive polymer, for example by spraying onto the said substrate 1 a solution of polyaniline and of a protonating agent in a volatile organic solvent. After elimination of the solvent by evaporation, a deposit 5 of polyaniline within the pores 3 of the porous substrate 1 is obtained, as shown in FIG. 2.

Figure 3:
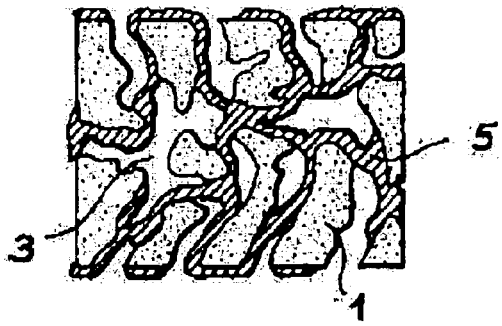

After this first cycle, the second cycle of deposition is performed under the same conditions, leading to the structure shown in FIG. 3 in which the deposits 5 are more substantial and begin to form a network within the porous substrate.

Figure 4:
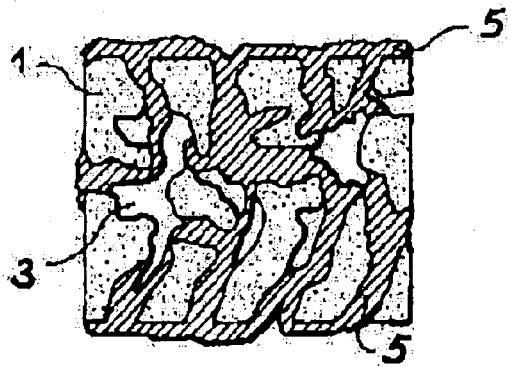

After this second cycle of deposition, a third cycle is performed under the same conditions, leading to the structure shown in FIG. 4, where the deposits 5 fill up certain pores 3 of the porous substrate 1 and form a coating, not only in the pores, but also on the external surface of the substrate.

Thus a conductive phase 5 is obtained within the pores and on the external surface of the substrate 1, enabling a macroscopic conductivity to be ensured on the two faces of the substrate and between the two faces of the substrate. The conductivity increases strongly after the second cycle of deposition. On the other hand, the increase is smaller after the third deposition because of the effect of saturation of the pores.

Exemplary embodiments of the method of the invention are described hereinafter.

EXAMPLE 1

In this example, the deposition of polyaniline is performed in a porous substrate constituted by a Millipore HVLP filter of poly(vinylidene fluoride) having a mean pore dimension of 0.45 $\mu$m.

The starting material is polyaniline in the form of emeraldine base, prepared at −15° C. using the method described in document [9]. The polyaniline has an intrinsic viscosity of 1.70 dl/g (at 25° C. in a 0.1% by weight solution in concentrated sulfuric acid).

The solution of polyaniline is prepared by adding 0.8 g of pre-dried polyaniline emeraldine base and 1.024 g of camphosulfonic acid (CSA), corresponding to 0.5 molecule of camphosulfonic acid per repeated unit of polyaniline, to a container containing 120 ml of trifluoroacetic acid (TFAA), and the mixture is subjected to vigorous agitation for 24 hours. The insoluble portion is then eliminated by centrifugation. The weight of dissolved polyaniline is determined by gravimetry as the difference between the initial weight of polyaniline emeraldine base and the weight of the undissolved fraction after its deprotonation.

A solution is obtained having a polyaniline concentration of 5 g/l.

This solution of protonated polyaniline in TFAA is very different from the majority of the solutions tried heretofore, for example, solutions of polyaniline in meta-cresol. The viscosity of the TFAA solution is noticeably much lower than that of the meta-cresol solution, for the same concentration of polyaniline. Furthermore, the color of the TFAA solution is dark blue instead of green in the case of the meta-cresol solution.

When the TFAA solution is evaporated on a microscope slide, changes can be observed in the color of the layer of deposited polymer, passing from blue at the start to greenish after 30–60 seconds, then to green after about two hours when the sample is completely dry.

Figure 5:
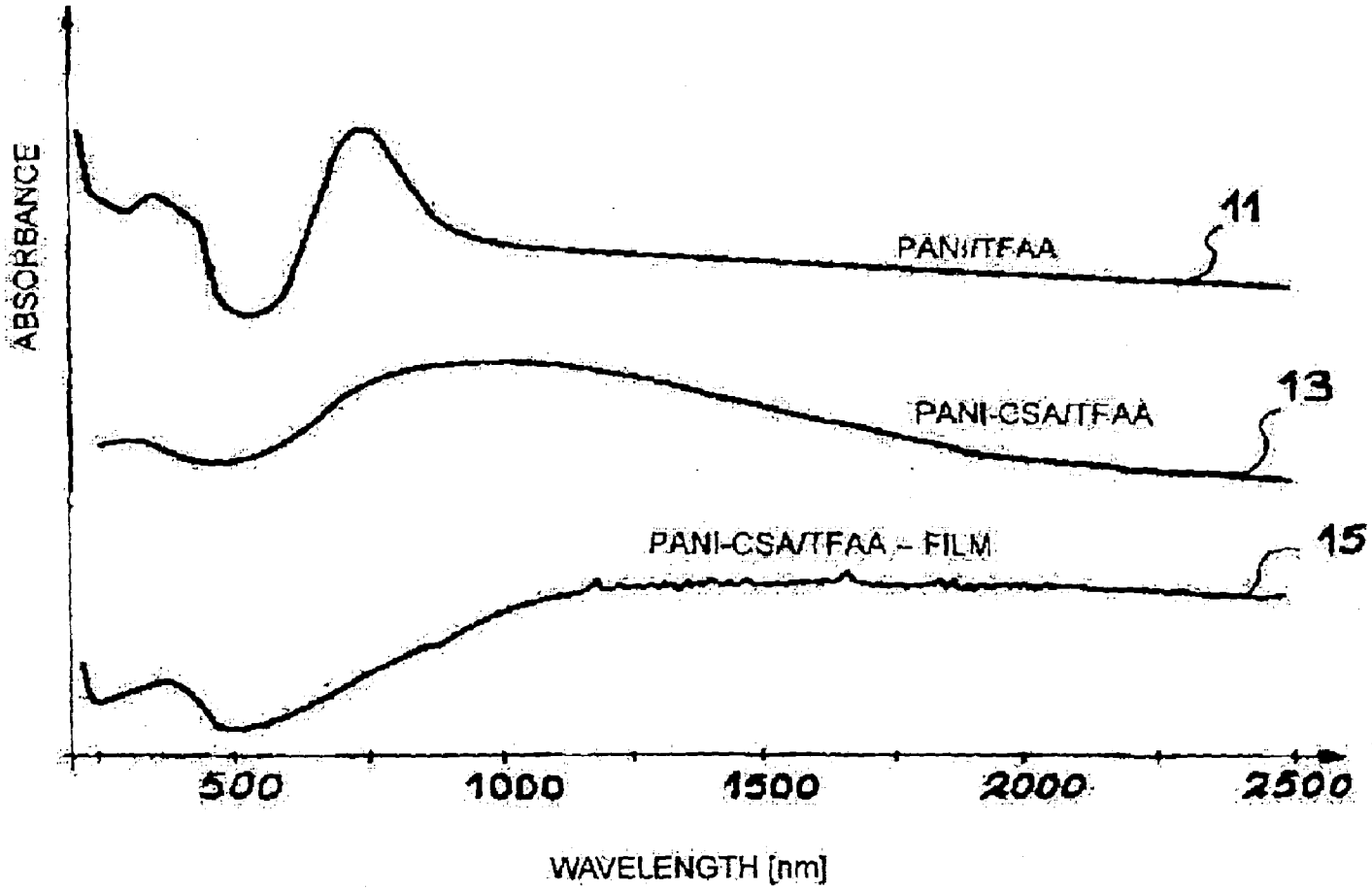
FIG. 5 illustrates the UV-VIS-NIR spectra of solutions and of a film cast from a solution according to the invention.

FIG. 5, which represents the US-VIS-NIR spectra of a solution of polyaniline in TFAA, without protonating agent (PANI/TFAA) (spectrum 11); of a solution of polyaniline and CSA in TFAA (PANI-CSA/TFAA) (spectrum 13); and of a film obtained by casting the (PANI-CSA/TFAA) solution and evaporating the solvent (spectrum 15), illustrates these modifications of color.

The solution of polyaniline and CSA in TFAA is then used to form a coating in the porous substrate by depositing this solution on the filter by means of a micropipette, or by immersing the substrate in this solution.

It is preferred to use a micropipette which gives a better control of the quantity of polyaniline. The dose of solution is 0.2 ml for the first deposition, which is sufficient to cover a surface about 4 cm in diameter.

After evaporation of the solvent, a polymer deposit is obtained which adheres well to the substrate and which cannot be eliminated mechanically.

Three successive depositions are then performed in the same manner. After each deposition, the volume conductivity of the composite material is determined by a method with four contacts on the surface of the material and taking into account the total thickness of the filter.

These measurements permit the comparison of the effect induced by several successive depositions of polyaniline on the conductivity and on the distribution of the polyaniline within the pores. The results obtained are given in the following Table 1.

TABLE 1

| Substrate | Number of Depositions | Conductivity [S/cm] |
|---|---|---|
| Millipore HVLP Filter | 1 | $5.5 \times 10^{-3}$ |
| | 2 | $2.3 \times 10^{-1}$ |
| | 3 | $3.6 \times 10^{-1}$ |

The content of polyaniline introduced by each deposition is about 0.4–0.8% by weight. The adhesion of the polymer deposit to the porous filter is excellent; the deposited layer cannot be separated mechanically from the surface. All the samples were subjected to an aging test consisting of 30 consecutive cycles of deprotonation-protonation (dedoping-doping) and drying. Merely a slight fall of the conductivity (at most 20%) was observed at the end of the trial.

EXAMPLE 2

In this example, the same mode of operation as in Example 1 is followed, but the porous substrate is a Santorius SM 118 filter of modified polytetrafluoroethylene, having a pore size of 0.45 $\mu$m.

The conductivity measurement results are given in Table 2. In this case, the quantity of polyaniline introduced after each deposition is about 1–1.5% by weight.

TABLE 2

| Substrate | Number of Depositions | Conductivity [S/cm] |
|---|---|---|
| Filter, Santorius SM118 | 1 | $1.7 \times 10^{-1}$ |
| | 2 | 4.3 |
| | 3 | 7.5 |

EXAMPLE 3

The same mode of operation is followed as in Example 1, but a filter paper of medium pore size is used as the substrate. The results obtained are given in Table 3.

TABLE 3

| Substrate | Number of Depositions | Conductivity [S/cm] |
|---|---|---|
| Filter paper, Medium density | 2 | $6.3 \times 10^{-3}$ |
| | 3 | $6.7 \times 10^{-2}$ |

EXAMPLE 4

The same mode of operation is followed as in Example 1, but a Whatman glass filter of pore size 1.0 $\mu$m is used as the substrate. In this case, the substrate is flexible, and the conductivity depends on the pressure used for the application of contacts. The conductivity, measured after three depositions, is $3\times10^{-2}$ S/cm for contacts without applied pressure.

It will be noted that in all the examples, the increase of conductivity during the second deposition is significantly higher than the growth during the third deposition. This can be explained by the low percolation threshold for the conductivity which is influenced by the morphology of the porous substrate.

REFERENCES CITED

[1]: Synthetics Metals, 60, 1993, pages 27–30
[2]: Anal. Chem., 1999, 71, pages 2231–2236
[3]: Anal. Chem., 1998, 70, pages 3946–3951
[4]: Synthetics Metals, 84, 1997, pages 107–108
[5]: Chem. Mater., 1994, 6, pages 1109–1112
[6]: WO-A-98/05040
[7]: WO-A-99/07766
[8]: Synthetics Metals, 48, 1992, pages 91–97
[9]: Synthetics Metals, 95, 1998, pages 29–45

What is claimed is:

1. Method for preparing an electrically conductive composite material, comprising an insulating porous substrate and a conductive polymer arranged in the pores of the insulating substrate, comprising performing at least one depositing cycle of the conductive polymer comprising the following steps:

(a) putting the porous substrate in contact with a solution of the conductive polymer in a volatile organic solvent, chemically inert with respect to the porous substrate, said organic solvent being chosen from the group consisting of acetic acid, halogenated derivatives of acetic acid and fluorinated alcohols: and (b) eliminating the volatile organic solvent by evaporation to form a deposit of conductive polymer in the pores of the porous substrate.

2. Method according to claim 1, in which three successive depositing cycles are performed.

3. Method according to claim 1, in which the solution of the conductive polymer contains 1 to 10 g/l of conductive polymer.

4. Method according to claim 1, wherein the organic solvent is trifluoroacetic acid.

5. Method according to claim 1, in which the conductive polymer is a polyaniline.

6. Method according to claim 5, wherein the polyaniline is in the form of emerald base.

7. Method according to claim 5, wherein the solution of the conductive polymer is a solution of polyaniline and of a protonating agent in an amphiphilic volatile organic solvent.

8. Method according to claim 7, wherein the protonating agent is chosen among the aliphatic and/or aromatic monoesters and diesters of phosphoric acid, sulfonic acids, and phosphonic acids.

9. Method according to claim 8, in which the protonating agent is camphorsulfonic acid.

10. Method according to claim 1, wherein the porous substrate is a material chosen among insulating polymers, filter papers, glasses and ceramics.

11. Method according to claim 1, wherein the contacting of the porous substrate with the solution of the conductive polymer is performed by immersion of the substrate in the solution or by spraying the solution onto the substrate.

* * * * *

UNITED STATES PATENT AND TRADEMARK OFFICE

CERTIFICATE OF CORRECTION

PATENT NO. : 6,753,041 B2
DATED : June 22, 2004
INVENTOR(S) : Adam Pron et al.

It is certified that error appears in the above-identified patent and that said Letters Patent is hereby corrected as shown below:

Column 8,
Line 9, change “emerald” to -- emeraldine --.

Signed and Sealed this

First Day of March, 2005

JON W. DUDAS
*Director of the United States Patent and Trademark Office*